US009160067B2

(12) United States Patent
Kwon et al.

(10) Patent No.: US 9,160,067 B2
(45) Date of Patent: Oct. 13, 2015

(54) ANTENNA IN WIRELESS TERMINAL WITH IMPROVED BUSHING

(71) Applicant: Samsung Electronics Co., Ltd., Gyeonggi-do (KR)

(72) Inventors: Taewook Kwon, Gyeonggi-do (KR); Youngjin Kang, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 379 days.

(21) Appl. No.: 13/849,723

(22) Filed: Mar. 25, 2013

(65) Prior Publication Data

US 2013/0249745 A1 Sep. 26, 2013

(30) Foreign Application Priority Data

Mar. 26, 2012 (KR) ..... 10-2012-0030771

(51) Int. Cl.
*H01Q 1/24* (2006.01)
*H01Q 1/50* (2006.01)
*H01Q 1/10* (2006.01)

(52) U.S. Cl.
CPC . *H01Q 1/50* (2013.01); *H01Q 1/10* (2013.01); *H01Q 1/244* (2013.01)

(58) Field of Classification Search
USPC ..... 343/702, 715, 901
See application file for complete search history.

(56) References Cited

U.S. PATENT DOCUMENTS

| | | | | |
|---|---|---|---|---|
| 5,812,093 | A * | 9/1998 | Thompson et al. | 343/702 |
| 5,856,806 | A * | 1/1999 | Koleda | 343/702 |
| 5,933,330 | A * | 8/1999 | Beutler et al. | 361/814 |
| 6,064,341 | A * | 5/2000 | Hassemer | 343/702 |
| 6,078,291 | A * | 6/2000 | Paulick et al. | 343/702 |
| 7,259,728 | B1 * | 8/2007 | Ostervall et al. | 343/901 |

* cited by examiner

*Primary Examiner* — Tan Ho
(74) *Attorney, Agent, or Firm* — Cha & Reiter, LLC

(57) ABSTRACT

An antenna for a wireless terminal is disclosed with an antenna bushing configured to provide enhanced antenna performance. The antenna bushing includes an antenna guide portion having an upper tubular portion supporting a radiator at substantially a point of extraction from the wireless terminal. A bushing fastening portion is disposed adjacent the upper tubular portion. A signal contact point of the antenna bushing transfers an antenna signal to/from an RF circuit point of the wireless terminal. At least a portion of the signal contact point is adjacent the upper tubular portion. The configuration may reduce deleterious effects of EMI from other circuit components of the wireless terminal.

16 Claims, 8 Drawing Sheets

ANTENNA IN WIRELESS TERMINAL WITH IMPROVED BUSHING

CLAIM OF PRIORITY

This application claims the benefit under 35 U.S.C. §119 (a) of a Korean patent application filed on Mar. 26, 2012 in the Korean Intellectual Property Office and assigned Serial No. 10-2012-0030771, the entire disclosure of which is hereby incorporated by reference.

BACKGROUND

1. Technical Field

The present disclosure relates to an antenna of a wireless terminal, and an antenna bushing thereof which improves antenna performance.

2. Description of the Related Art

In recent designs of wireless terminals such as smart phones, laptops and GPS devices, an extractable antenna has been employed to handle transmission/reception at relatively lower frequency bands, e.g., UHF and VHF, and in particular, to receive digital multimedia broadcasting (DMB) signals at those bands. This extractable antenna is typically separate and independent from other, built-in antennas used for communication at higher frequencies (e.g., cellular band frequencies). The extractable antenna is typically a monopole, whip type antenna extractable from the housing of the wireless terminal, and retractable back into the housing via manual manipulation. For the extractable antenna of a general purpose or the DMB, a reception type antenna has been broadly used, and the reception type antenna requires an antenna bushing to support the monopole radiator, the antenna bushing being part of an antenna module.

One of the factors that impede antenna performance is the electromagnetic interference (EMI) which is emitted from peripheral electronic components. The EMI disturbs and affects an electronic circuit coupled to the extractable antenna. The disturbance may interrupt or limit the effective performance of the antenna. It is also well known that the EMI causes signal loss along with lowering the antenna performance.

FIG. 1 is a diagram illustrating a related art antenna bushing of a wireless terminal 5, and its structure depicted in a side view. The antenna bushing 7 is fastened to a separate boss 8 by aligning a hole 2 of a fastening portion 3 with a hole of the boss 8 and utilizing a fastening member through the two holes. The boss 8 is different from a rear cover boss 6 used for assembling the rear cover together with a front cover.

The antenna bushing 7 is composed of an upper, closed collar portion 7*a,* a lower, partial collar portion 7*b,* the fastening portion 3 and a signal contact plate 4 which makes electrical contact at a signal contact point 4' (shaded circle) with a receiver contact point (not shown) of the wireless terminal. An antenna signal beginning point 1 is considered approximately in a central region of the closed collar portion 7*a,* which is where good electrical contact between the antenna bushing 7 and the antenna radiator is made. The signal contact point 4' is located at a vertical distance below the antenna signal beginning point 1. The longer this distance is, the higher the signal loss occurring due to the EMI. Particularly, when electronic components such as an ear jack, a motor, and sensors are installed adjacent to the antenna bushing, the amount of the signal loss increases due to the negative impact of the EMI emitted from such peripheral electronic components. Accordingly, there exists a need for an antenna bushing that improves the antenna performance while reducing the signal loss and enhancing the durability of the antenna.

SUMMARY

The present disclosure provides an antenna with a bushing that improves an antenna performance by extending the length of an antenna radiator portion externally exposed outside of a device when the antenna is extracted from the device.

The present disclosure further provides an antenna with a bushing that reduces the amount of signal loss and improves the antenna performance by shortening a distance between an antenna signal beginning point and a signal contact point of the antenna bushing.

An antenna for a wireless terminal is disclosed with an antenna bushing configured to provide enhanced antenna performance. The antenna bushing includes an antenna guide portion having an upper tubular portion supporting a radiator at substantially a point of extraction from the wireless terminal. A bushing fastening portion is disposed adjacent the upper tubular portion. A signal contact point of the antenna bushing transfers an antenna signal to/from an RF circuit point of the wireless terminal. At least a portion of the signal contact point is adjacent the upper tubular portion.

The configuration may reduce deleterious effects of EMI from other circuit components of the wireless terminal. The configuration may also enable an extraction distance of an antenna radiator to be longer than in the related art, for a wireless terminal with a given form factor, thereby improving antenna performance.

BRIEF DESCRIPTION OF THE DRAWINGS

Aspects, features and advantages of the presently disclosed technology will be more apparent from the following detailed description in conjunction with the accompanying drawings, in which.

DETAILED DESCRIPTION OF EXEMPLARY EMBODIMENTS

Figure 1:
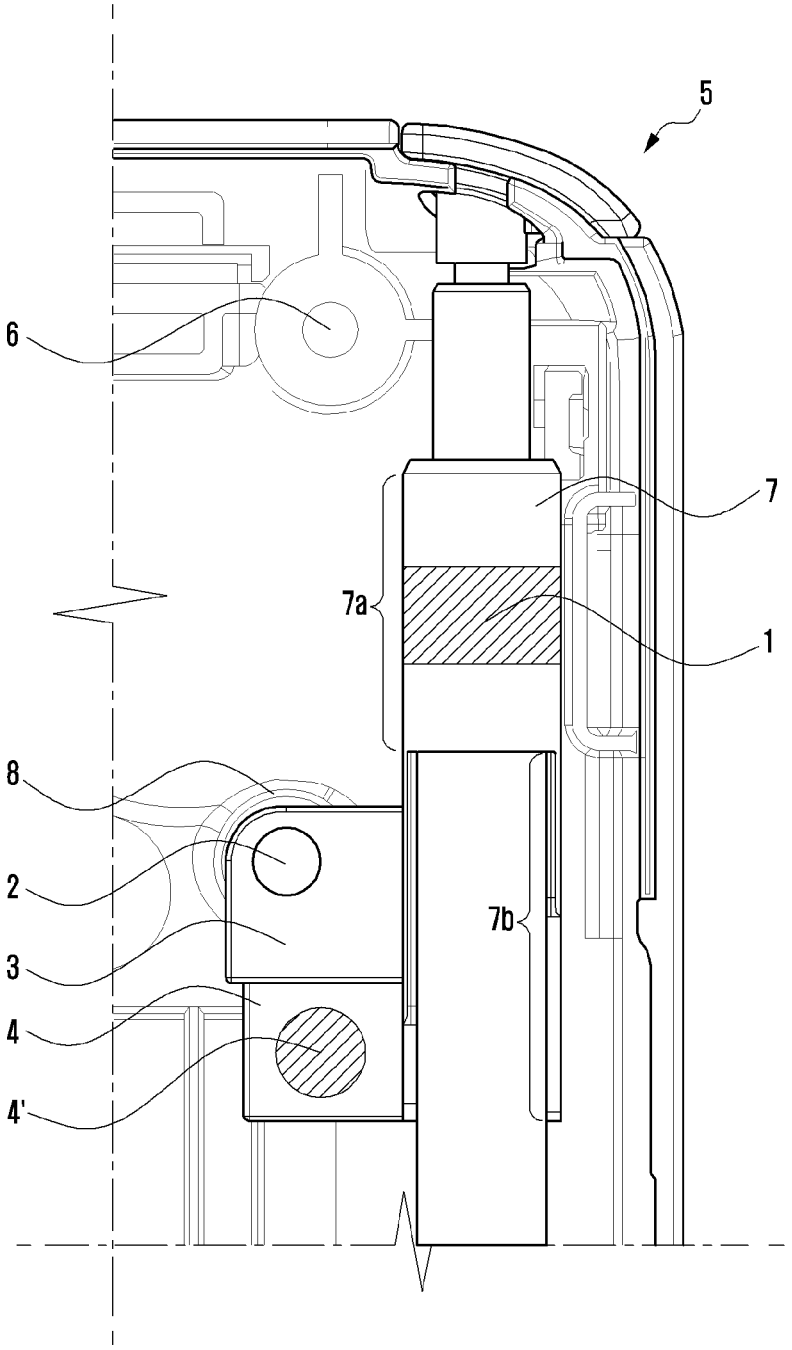
FIG. 1 (RELATED ART)
FIG. 1 is a view illustrating a state in which a related art antenna bushing is fastened to a rear cover.

Hereinafter, exemplary embodiments of the present invention are described in detail with reference to the accompanying drawings. The same reference numbers are used throughout the drawings to refer to the same or like parts. The views in the drawings are schematic views only, and are not intended to be to scale or correctly proportioned. Detailed descriptions of well-known functions and structures incorporated herein may be omitted to avoid obscuring the subject matter of the present invention.

As used in this document, including the Claims section, the words "a" or "an" mean one or more than one. The term "plurality" means two or more than two. The term "another" is defined as a second or more. The words "comprising", "including", "having" and the like are open ended. Reference herein to "one embodiment", "embodiments", "an embodiment", "first embodiment" or similar term means that a particular feature, structure, or characteristic described in connection with the embodiment is included in at least one embodiment. The appearances of such phrases in various places throughout this disclosure are not necessarily all referring to the same embodiment. Furthermore, the particular features, structures, or characteristics may be combined in any suitable manner on one or more embodiments without limitation. The terms "may" or "can" are used herein to refer to at least an optional element, feature, function, characteristic, advantage, etc., of a described embodiment. Terms such as "substantially" or "generally" signify equality or an approximation with respect to a parameter.

An antenna mounted in an antenna bushing according to an exemplary embodiment of the present invention can be substituted for various types of antennas including a reception type antenna. For conciseness of explanation, a reception type DMB antenna is described hereinafter; however, it is understood that embodiments applicable to other types of antennas are available. Antennas of the present disclosure can be employed in fixed as well as portable wireless terminals.

Figure 2:
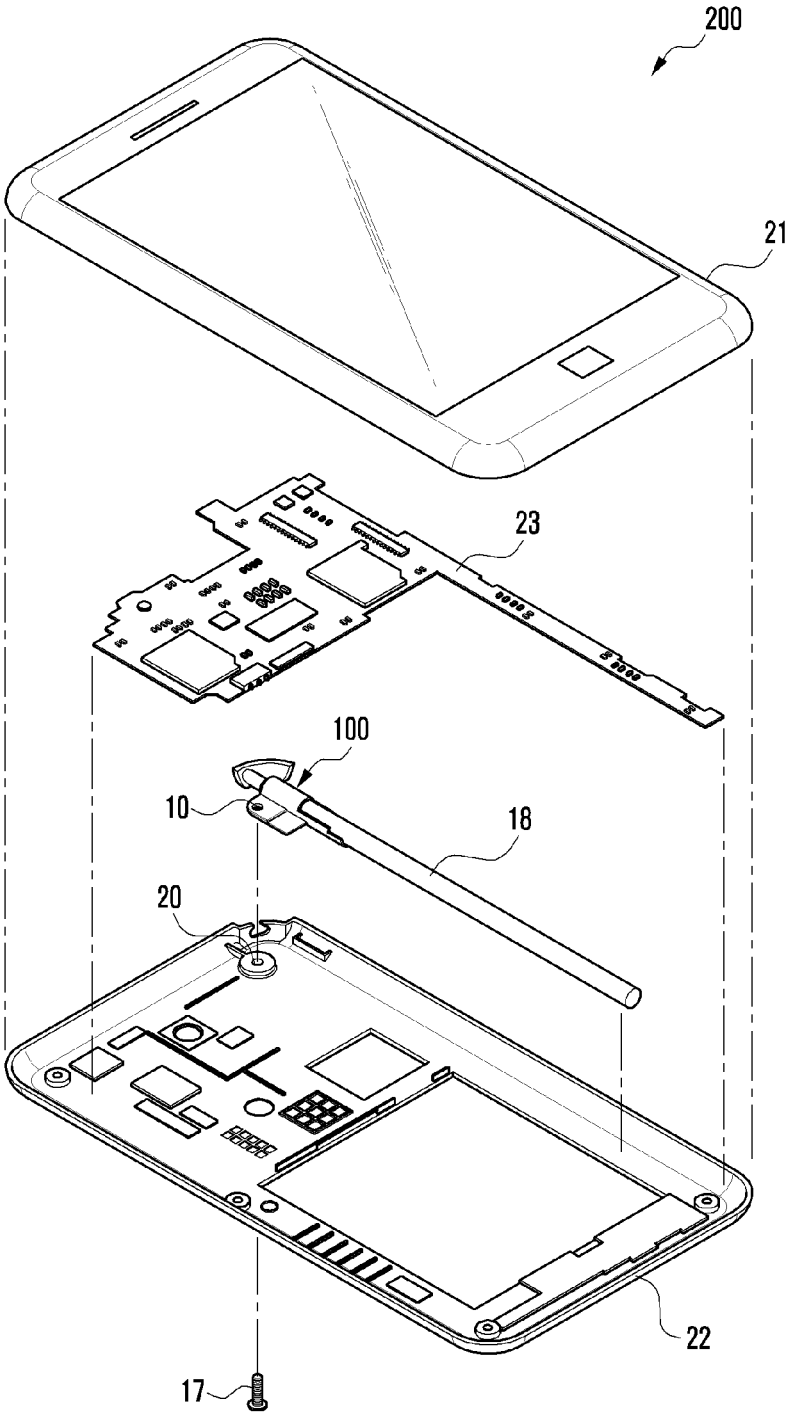
FIG. 2 is an exploded perspective view illustrating a mounting position of an antenna bushing according to an exemplary embodiment of the present invention.

FIG. 2 is an exploded perspective view illustrating a mounting position of an antenna bushing 100 according to an exemplary embodiment of the present invention. An antenna radiator 18 for transmitting and/or receiving a wireless signal is supported by the antenna bushing 100. In the retracted position, the radiator 18 is accommodated within a space of the wireless terminal 200 on one side. Thus, an antenna composed of the radiator 18 and the antenna bushing 100 is mounted and installed at one side (e.g., an upper end of the left or right side) within a rear cover 22. The wireless signal may be a broadcasting (e.g., DMB) signal at UHF and/or VHF bands. Hereinafter, it is assumed that a broadcasting signal is received.

Electronic components are mounted at a circuit board (e.g., PCB) 23. The antenna bushing 100 performs a function of supporting the radiator 18 and of transferring the broadcasting signal received through the radiator 18 to the circuit board 23. The rear cover 22 includes a plurality of bosses (with centralized holes) to be fastened to the front cover 21. One of the bosses (hereinafter, a rear cover boss 20) is fastened to the antenna bushing 100 by a fastening member 17 inserted through the boss hole and a bushing hole 10. The bushing hole 10 is aligned with the hole of rear cover boss 20 in the fastened state, to secure the antenna bushing 100 to the rear cover 22. The fastening member 17 in the exemplary embodiment is a screw; however, other fastening members such as pins or compression posts can be alternatively employed. Further, the rear cover 22, the antenna bushing 100, the front cover 21, and other electronic components may be fastened together by the fastening member 17.

Figure 3:
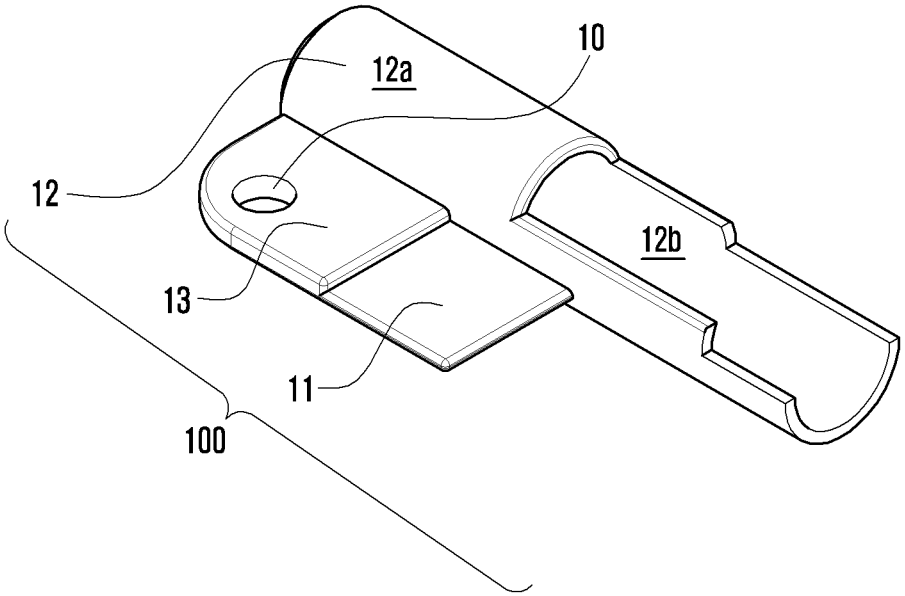
FIG. 3 is a perspective view illustrating the antenna bushing shown in FIG. 1 according to an exemplary embodiment of the present invention.

FIG. 3 is a perspective view illustrating the antenna bushing 100 shown in FIG. 2 according to an exemplary embodiment of the present invention. The bushing hole 10 is formed in a bushing fastening portion 13. The antenna bushing 100 comprises an antenna guide portion 12, the bushing fastening portion 13, and a signal contact portion 11. These parts may be all connected to one another and formed in one body. The antenna bushing 100 is made of a conductive material.

Referring to FIGS. 2 and 3, the bushing fastening portion 13 fastens the antenna bushing 100 to the rear cover 22. The signal contact portion 11 transfers the received broadcasting signal to a circuit signal portion at the circuit board 23, where the circuit signal portion is an input connection point to an RF receiving circuit. The signal contact portion 11 and bushing fastening portion 13 may each be in the shape of plates extending laterally from the antenna guide portion 12. Antenna guide portion 12 is composed of an upper, closed collar portion 12*a* (i.e., a tubular portion) and a lower, partial collar portion 12*b*. The upper tubular portion 12*a* supports antenna radiator 18 at substantially a point of extraction from the wireless terminal 200 (see, e.g., FIG. 8, view (b)). At least a portion of the signal contact portion 11 is adjacent to the closed collar portion 12*a* to reduce the distance from a signal contact point and an antenna signal beginning point, explained further below. The partial collar portion 12*b* may be composed of two different sections with differing, partial circular cross sections ("C" shaped cross sections).

Figure 4:
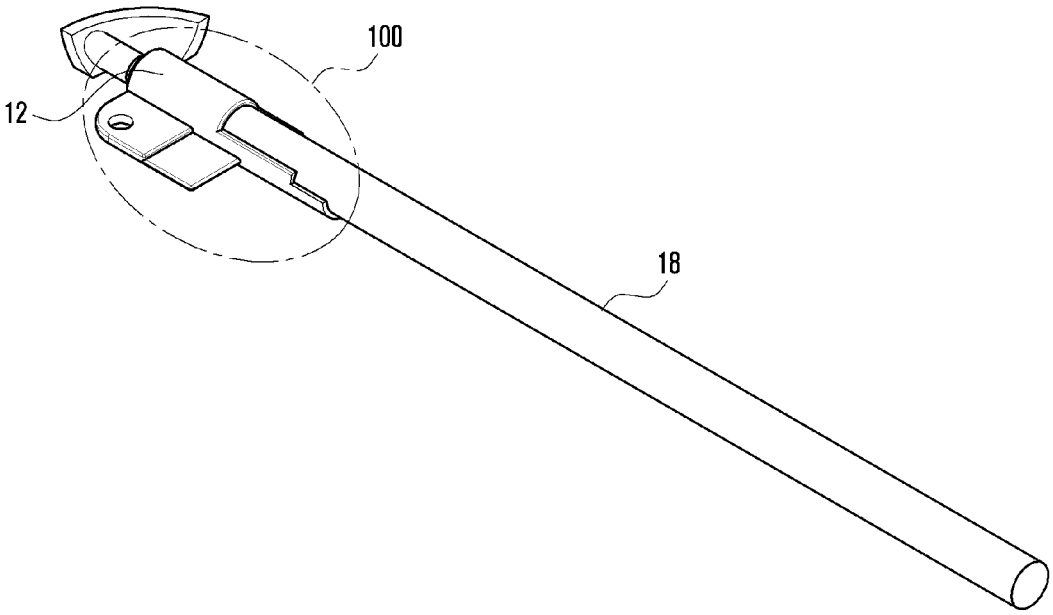
FIG. 4 is a view illustrating an antenna bushing assembled with an antenna radiator according to an exemplary embodiment of the present invention.

FIG. 4 is a view illustrating an antenna bushing assembled with an antenna radiator 18 according to an exemplary embodiment of the present invention.

Referring to FIGS. 2 and 4, the radiator 18 is inserted into the antenna guide portion 12. The antenna guide portion 12 supports the radiator 18 and prevents the radiator 18 from being separated when it is extracted from the wireless terminal. Radiator 18 may be a whip type antenna radiator, and although shown as a linear member, may include a helical section or may be entirely helical. Antenna radiator 18 may be composed of a plurality of interlocking telescoping metal tubes.

Figure 5:
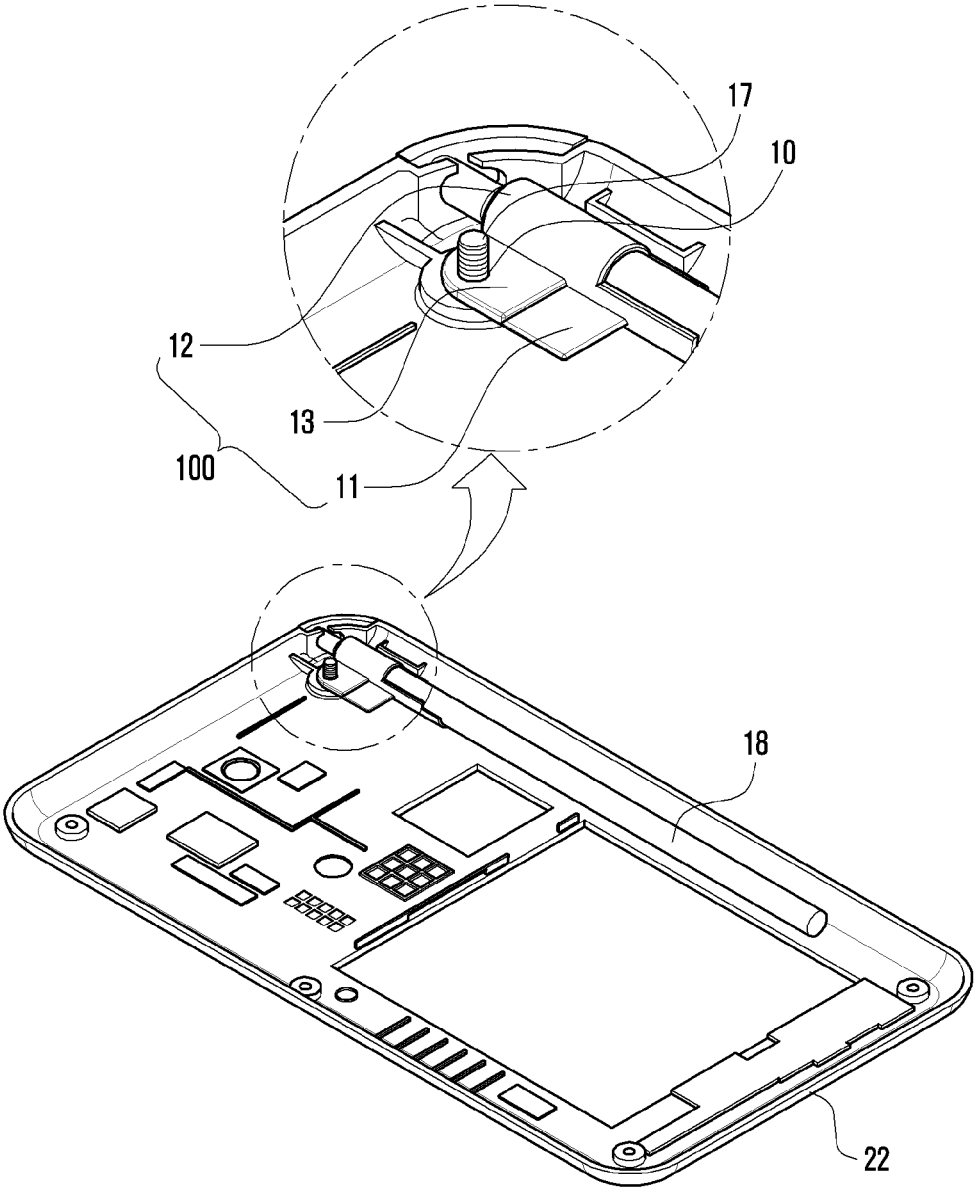
FIG. 5 is a perspective view illustrating a state in which the antenna bushing having an antenna is fastened to a rear cover.

FIG. 5 is a perspective view illustrating a state in which the antenna bushing retaining an antenna radiator is fastened to a rear cover. Here, the antenna bushing hole 10 and the hole of the rear cover boss 20 are aligned to allow the antenna bushing 100 and the rear cover boss 20 to be fastened together by the fastening member 17. The antenna guide portion 12 and the signal contact portion 11 are positioned at an upper end portion of the device 200.

Figure 6:
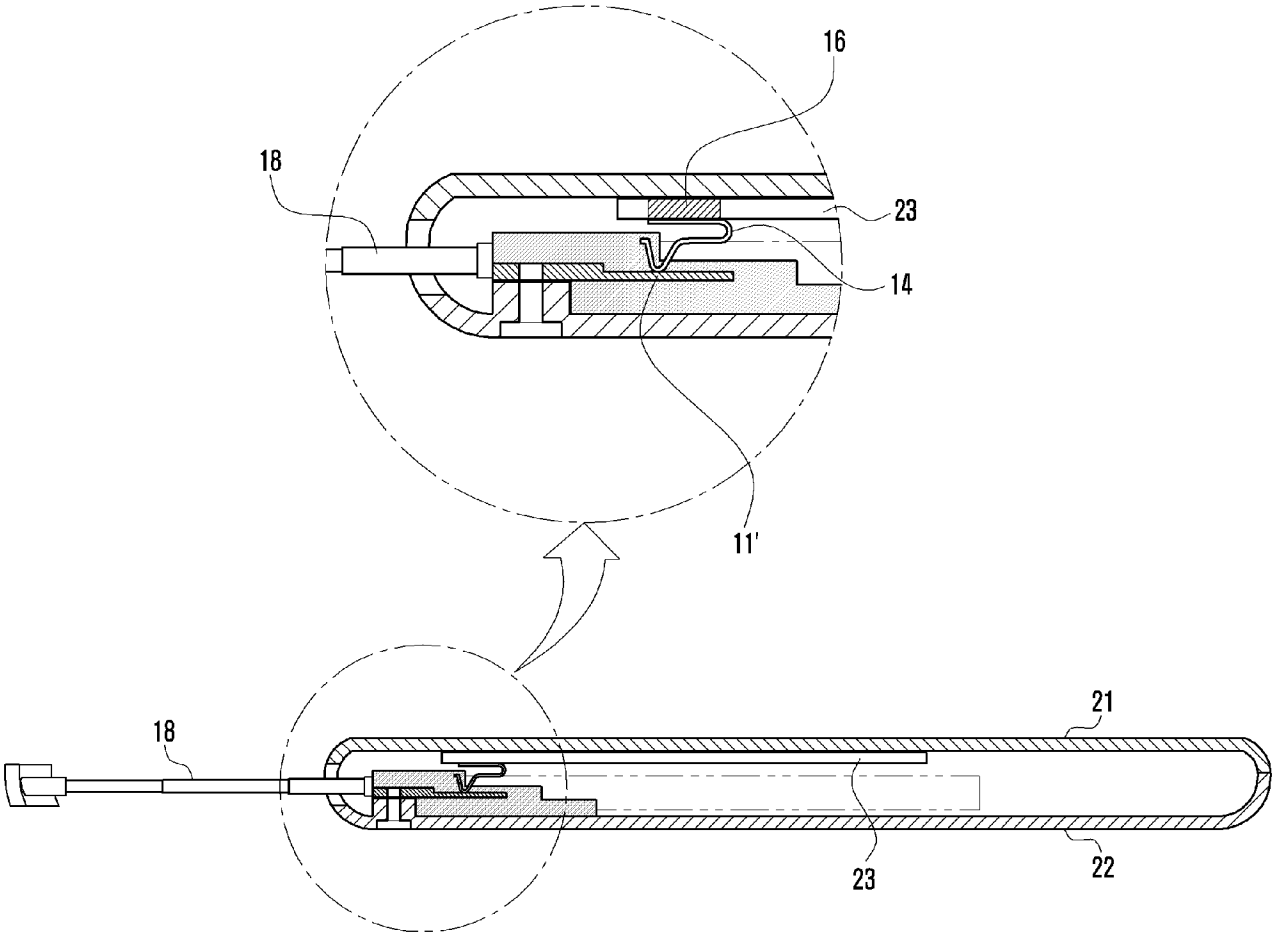
FIG. 6 is a cross-sectional view illustrating a connection for transmitting a broadcasting signal from a signal contact point to a circuit signal portion by a connection member according to an exemplary embodiment of the present invention.

FIG. 6 is a cross-sectional view illustrating a connection for transferring a broadcasting signal from a signal contact point to a circuit signal portion by a connection member according to an exemplary embodiment of the present invention.

Referring to FIGS. 2 and 6, the antenna bushing 100 performs a function of transferring the broadcasting signal to a circuit signal portion 16 disposed in the circuit board 23 by an electrical connection member 14, wherein the connection member 14 electrically connects a signal contact point 11' to the circuit signal portion 16. Signal contact "point" 11' is a surface area of the signal contact portion 11 that actually makes contact with the connection member 14. The connection member 14 is embodied as a C-Clip which has a conductive and elastic material; however, other connection members can be alternatively employed. The circuit signal portion 16 is a connection point to an RF circuit disposed on circuit board 23.

Figure 7:
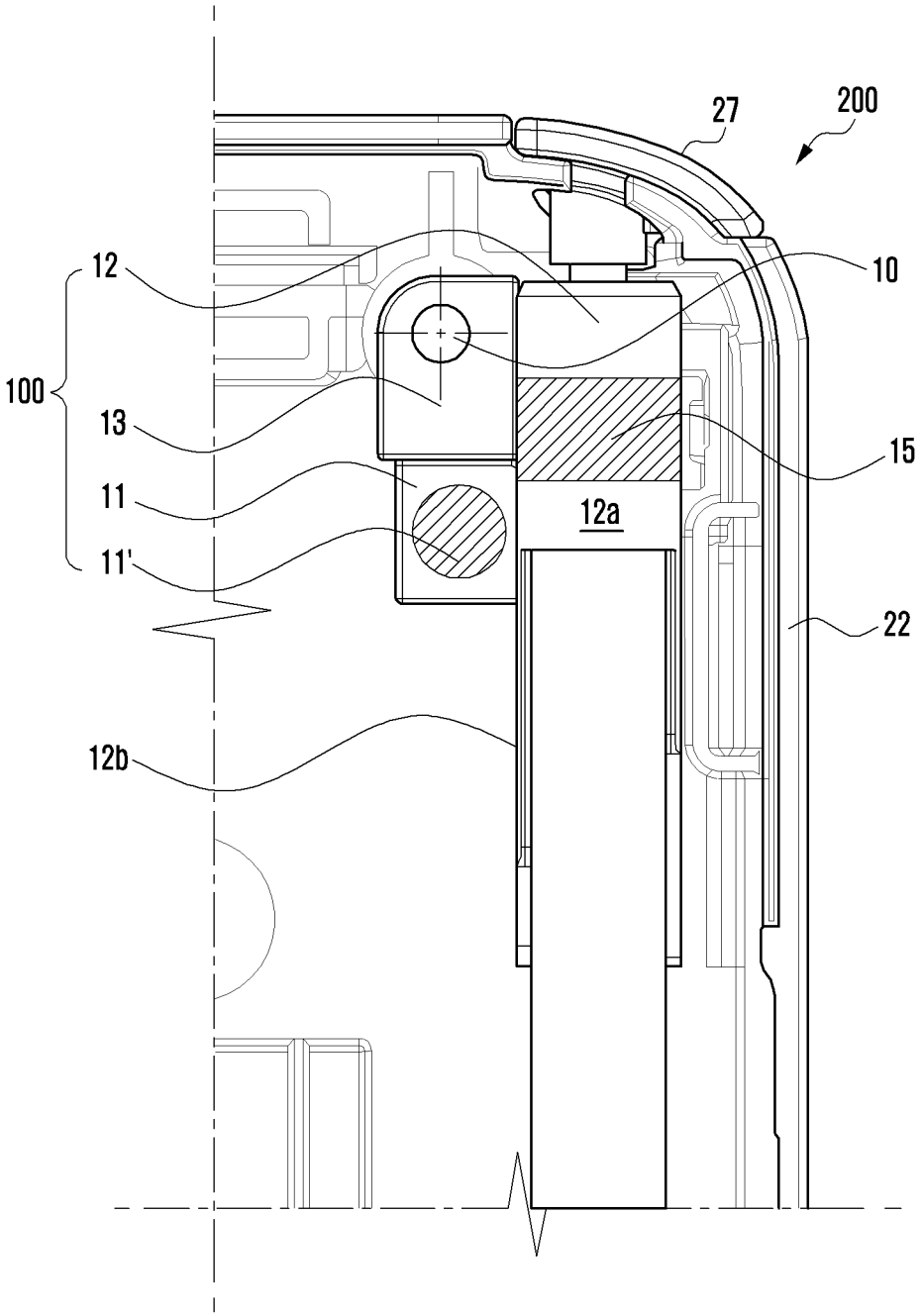
FIG. 7 is a view illustrating a state in which an antenna bushing is fastened to a rear cover according to an exemplary embodiment of the present invention.

FIG. 7 is a view illustrating a state in which an antenna bushing is fastened to a rear cover according to an exemplary embodiment of the present invention. The antenna guide portion 12 has an antenna signal beginning point 15, which can be at a centralized region of the closed collar portion 12*a* where good electrical contact between the antenna bushing 100 and the antenna radiator 18 is made. Herein, the antenna signal beginning point 15 is considered anywhere within the closed collar portion 12*a* of the antenna bushing 100. In FIG. 7, the antenna signal point 15 is described as being located at the central portion of the closed collar portion 12*a* (i.e., a tubular portion) as shown. However, it is understood that the location of the antenna signal point 15 is described as an exemplary embodiment for conciseness of explanation. It is not limited to the description. Thus, the antenna signal point 15 can be located anywhere within the closed collar portion 12*a* of the antenna bushing 100. Both the signal contact point 11' and the closed collar portion 12*a* having the signal beginning point 15 are positioned at an upper end portion of the device 200. More specifically, at least a portion of the signal contact point 11' is adjacent (side by side) the closed collar portion 12*a* at the same distance below the top of the device 200 (i.e., at the same horizontal level when the device is oriented vertically, as shown in FIG. 7). Further, by forming the signal contact point 11' adjacent to the signal beginning point 15, a distance between the points 15 and 11' is closer than that between the related art signal beginning point 1 and the signal contact point 4' as shown in FIG. 1.

The antenna bushing hole 10 is aligned with the hole of the rear cover boss 20 to be fastened by the fastening member 17. Thus, the antenna bushing 100 does not need a separate boss as required in the related art antenna bushing (i.e., boss 8 of FIG. 1 can be eliminated in the present embodiment). The antenna further has a cap 27 that preferably conforms to the shape of the housing of device 200 to provide a nearly continuous outer surface when the antenna is retracted, as illustrated.

As described earlier, the longer the distance between the antenna signal beginning point and the signal contact point, the worse the antenna performance becomes. Antenna performance degradation due to a long distance between points 4 and 1 as in FIG. 1 is a result of more signal loss due to the negative impact of the EMI when the RF signal travels a significant distance between the signal contact point and antenna signal beginning point. Particularly, when electronic components such as an ear jack, a motor, and sensors are installed adjacent to the antenna bushing 100, the amount of signal loss increases due to the EMI emitted from the peripheral electronic components.

To minimize the EMI disturbance and improve the antenna performance, in the present embodiment, the signal contact point 11' is formed as close to the antenna signal beginning point 15 as possible while being separated away from peripheral electronic components. The amount of the signal loss is reduced compared to the related art as the distance between the signal contact point 11' and the signal beginning point 15 is shorter.

Figure 8:
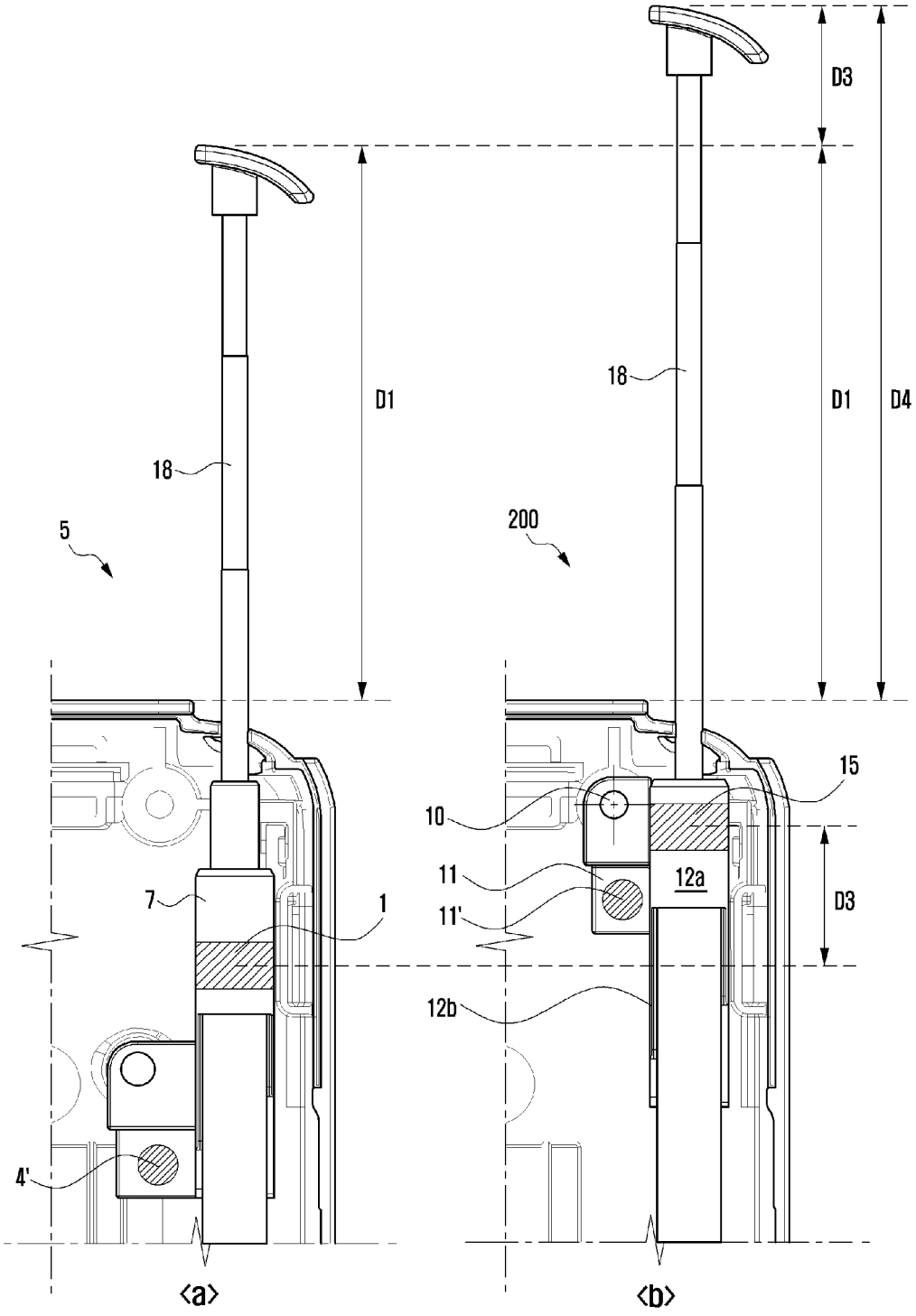
FIG. 8 depicts views of devices with extracted antennas to illustrate a change in an antenna portion externally exposed outside of a device when an antenna is extracted according to an exemplary embodiment of the present invention.

FIG. 8 are views of devices with extracted antennas to illustrate a change in the length of an antenna portion externally exposed outside of a wireless terminal device.

View (a) illustrates a length D1 of an antenna portion exposed outside of the related art device 5 when the antenna radiator 18 is fully extracted in the related art antenna bushing 7 (with all telescopic tubes of a radiator 18 fully drawn out). View (b) illustrates the same fully extracted condition with the same radiator 18 when the antenna bushing 100 in accordance with the invention is employed within a device 200, which can be the same form factor as device 5.

Comparing the views (b) and (a), the length D4 of the radiator exposed outside of the device 200 is longer than the length D1 when the radiator is extracted from the related art device 5. Since the antenna portion exposed outside of the device is increased as much as the length D3, the antenna performance is improved in device 200. Comparing the arrangement of view (a), the antenna signal contact point 11' is formed adjacent to the antenna signal beginning point 15 (the two points 11' and 15 are at substantially the same distance below the top of device 200). Moreover, the bushing hole 10 is positioned over the rear cover boss hole located at the upper end portion of the device 200. Further, as the distance between the antenna signal beginning point 15 and the signal contact point 11' is closer than the corresponding distance in view (a), the EMI disturbance is reduced. The overall antenna performance, therefore, is improved.

Although exemplary embodiments of the present invention have been described in detail hereinabove, it should be clearly understood that many variations and modifications of the basic inventive concepts herein described, which may appear to those skilled in the art, will still fall within the spirit and scope of the exemplary embodiments of the present invention as defined in the appended claims. For example, while the bushing fastening portion 13 is exemplified above the signal contact portion 11, it is conceivable that their positions could be reversed such that portion 11 would be disposed above portion 13 in an alternative configuration.

What is claimed is:

1. An antenna of a wireless terminal, comprising:

an antenna bushing including:

an antenna guide portion having an upper tubular portion supporting a radiator at substantially a point of extraction from the wireless terminal;

a bushing fastening portion adjacent to the upper tubular portion; and a signal contact point to transfer an antenna signal to/from a circuit point of the wireless terminal, wherein at least a portion of the signal contact point is adjacent to the upper tubular portion.

2. The antenna of claim 1, wherein the extraction point is at an upper point of the wireless terminal, and the bushing fastening portion is above the signal contact point.

3. The antenna of claim 1, wherein the bushing fastening portion is in the shape of a plate extending laterally from the antenna guide portion.

4. The antenna of claim 1, wherein the signal contact point is a surface on a signal contact plate extending laterally from the antenna guide portion.

5. The antenna of claim 1, wherein the antenna guide portion further comprises a partial collar portion with at least one C-shaped cross section, disposed below the tubular portion.

6. The antenna of claim 1, wherein the bushing fastening portion comprises a first hole which is aligned with a boss hole of a housing cover of the wireless terminal, the antenna bushing is secured to the wireless terminal housing via a fastening member through the boss hole and the first hole.

7. The antenna of claim 6 wherein the fastening member is a screw.

8. The antenna of claim 7, wherein the fastening member assembles the rear cover, the antenna bushing, and a front cover of the wireless terminal housing.

9. The antenna of claim 6, wherein the boss hole is a hole in a boss of a rear cover of the housing, the antenna bushing being fastened to the rear cover via the fastening member disposed through the bushing hole and boss hole.

10. The antenna of claim 1, wherein the antenna radiator is a whip antenna radiator, the antenna guide portion supports the radiator when the radiator is extracted, and prevents the radiator from being separated from the antenna bushing.

11. The antenna of claim 1, wherein the antenna guide portion, the bushing fastening portion, and the signal contact point are made of a conductive material.

12. The antenna of claim 1, wherein the antenna is configured for UHF and/or VHF operation.

13. The antenna of claim 1, wherein the at least a portion of the signal contact point and the adjacent upper tubular portion are side by side at the same distance below a common top point of the wireless terminal.

14. A wireless terminal comprising:

a housing retaining a retractable antenna, the antenna comprising an antenna bushing which includes:

an antenna guide portion having an upper tubular portion supporting a retractable radiator at substantially a point of extraction from the wireless terminal;

a bushing fastening portion adjacent to the upper tubular portion; and a signal contact point to transfer an antenna signal to/from a circuit point of the wireless terminal, wherein at least a portion of the signal contact point is adjacent to the upper tubular portion.

15. The wireless terminal of claim 14, further comprising:

a circuit board having the circuit point, the circuit point being a connection point to an RF circuit mounted on the circuit board; and a connection clip to electrically connect the connection point and the signal contact point of the antenna bushing.

16. The wireless terminal of claim 15, wherein the connection clip is a C clip.

* * * * *